United States Patent [19]

Carr

[11] 3,990,950

[45] Nov. 9, 1976

[54] LEVELER DOOR FOR COKE OVENS

[75] Inventor: Hugh B. Carr, McMurray, Pa.

[73] Assignee: Bloom Engineering Company, Inc., Pittsburgh, Pa.

[22] Filed: Aug. 22, 1975

[21] Appl. No.: 607,016

Related U.S. Application Data

[63] Continuation of Ser. No. 394,760, Sept. 6, 1973, abandoned.

[52] U.S. Cl. ..... 202/248; 110/173 R

[51] Int. Cl.[2] ..... C10B 1/06

[58] Field of Search ..... 202/242, 248; 110/173 R

[56] References Cited

UNITED STATES PATENTS

| | | | |
|---|---|---|---|
| 809,344 | 1/1906 | Walstrom | 110/173 R |
| 2,338,675 | 1/1944 | Van Ackeren | 202/248 |
| 2,442,391 | 6/1948 | Wilputte | 202/248 |
| 2,584,404 | 2/1952 | Webb | 110/173 R |
| 2,812,292 | 11/1957 | Tucker | 202/248 |
| 2,820,002 | 1/1958 | Wolff | 202/248 |
| 3,705,087 | 12/1972 | Grumm et al. | 202/248 |

*Primary Examiner*—Jack Sofer

*Attorney, Agent, or Firm*—Webb, Burden, Robinson & Webb

[57] ABSTRACT

A leveler door for sealing the leveler opening in a coke oven door; the oven door of the type having leveler door mounting and latching apparatus associated therewith. The leveler door comprising a flexible closure member possessing spring-like properties at elevated temperatures and having a generally concave shape, terminating in a flexible sealing edge at its outer periphery. The sealing edge is formed at an angle of less than 90° relative to the plane of the leveler opening. Means for securing the closure member to the mounting and latching apparatus of the coke oven door are disclosed, whereby the compressive closing force supplied by the mounting and latching apparatus causes the concave closure member to move toward the leveler opening causing the sealing edge to concurrently flex outwardly from the leveler opening while sealably engaging the coke oven door adjacent the leveler opening. Also disclosed is a detachable sealing seat adapted for placement around the leveler opening providing improved sealability in combination with the flexible sealing edge of the closure member.

20 Claims, 10 Drawing Figures

LEVELER DOOR FOR COKE OVENS

This is a continuation of application Ser. No. 394,760, filed Sept. 6, 1973, now abandoned.

BACKGROUND OF THE INVENTION

My invention relates generally to coke oven doors and more particularly to leveler doors for sealing the leveler opening in coke oven doors.

A coke oven door on the pusher side of the oven is usually provided with an opening near the top to permit the insertion of a leveler bar therethrough. The leveler bar is pushed into the coke oven chamber and reciprocally moved several times until the surface of the coal charge in the oven is substantially leveled. When the leveler bar is withdrawn from the coke oven, the leveler opening is closed using a door or lid, and the coking process is begun. During the coking process, gaseous distillation products are formed which result in the condensation of tar and pitch-like deposits in the area of the coke oven door and particularly its leveler door. If sulfur bearing coal is coked, a corrosive gas is, likewise, evolved. Heretofore, the leveler doors most commonly used are of heavy cast iron and a metal to metal seal is effected around the leveler opening by machining the edge of the leveler door and its corresponding seating surface on the cast iron coke oven door. These cast iron leveler doors have proved to be expensive and unsatisfactory in that the sealing edge of the door and its corresponding seating surface must be repeatedly cleaned to remove the tarry deposits in order to maintain the required metal to metal seal. If the seal area is not cleaned, the seal between the leveler door and over door is not achieved and gases escape. The case iron leveler doors and seating surfaces, likewise, are attacked by the corrosive gases generated by the coking process. Periodically, the coke oven doors must be removed from the coke ovens and the sealing surfaces of the leveler doors and seating surfaces are rebuilt by deposition of weld metal and subsequent machining operation. If these expensive maintenance operations are not frequently done, the build-up of tarry deposits and the action of the corrosive gases cause gaps between the conventional leveler door and its seating surface which results in the harmful emission of gaseous distillation products into the atmosphere. Prior attempts have been made to solve the problems of sealing leveler doors, for example, U.S. Pat. Nos. 2,442,391 – Wilputte, and 2,820,002 – Wolff. These attempts have not been completely successful in that they require relatively complicated leveler door constructions which are expensive to manufacture and maintain.

My invention solves the problems heretofore encountered by providing a leveler door which effectively seals the leveler opening and greatly reduces the maintenance previously required by such doors.

My invention further provides a leveler door which slidably engages the seating surface adjacent the leveler opening during closing and tightly seals the leveler opening due to its flexible, concave shape.

My invention still further provides a leveler door and sealing seat which are capable of withstanding the corrosive effects of the coke oven gases.

My invention further provides a leveler door which is adapted for use on any of the various coke oven doors used in the industry.

Briefly, my invention provides a leveler door for sealing the leveler opening in a coke oven door; the oven door of the type having conventional leveler door mounting and latching apparatus associated therewith. The leveler door of my invention comprises a flexible closure member, preferably stainless steel, possessing spring-like properties at elevated temperatures. The closure member has a generally concave shape and terminates in a flexible sealing edge at its outer periphery. The sealing edge is formed at an angle of less than 90° relative to the plane of the leveler opening. Means for securing the closure member to the mounting and latching apparatus of the oven door are provided whereby the compressive closing force supplied by the mounting and latching apparatus causes the rear of the concave closure member to move toward the leveler opening, causing the sealing edge to concurrently flex outwardly from the leveler opening while slidably engaging the coke oven door adjacent the leveler opening. In the closed position, the concave shape of the closure member springably maintains the flexible sealing edge in compressive and sealing engagement with the area adjacent the leveler opening. A corrosion resistant and heat resistant sealing seat may also be provided on the oven door surrounding the leveler opening. The corrosion resistant sealing seat further reduces the need for maintenance and insures a more uniform and longer life seal between the leveler door and the oven door.

Figure 1:
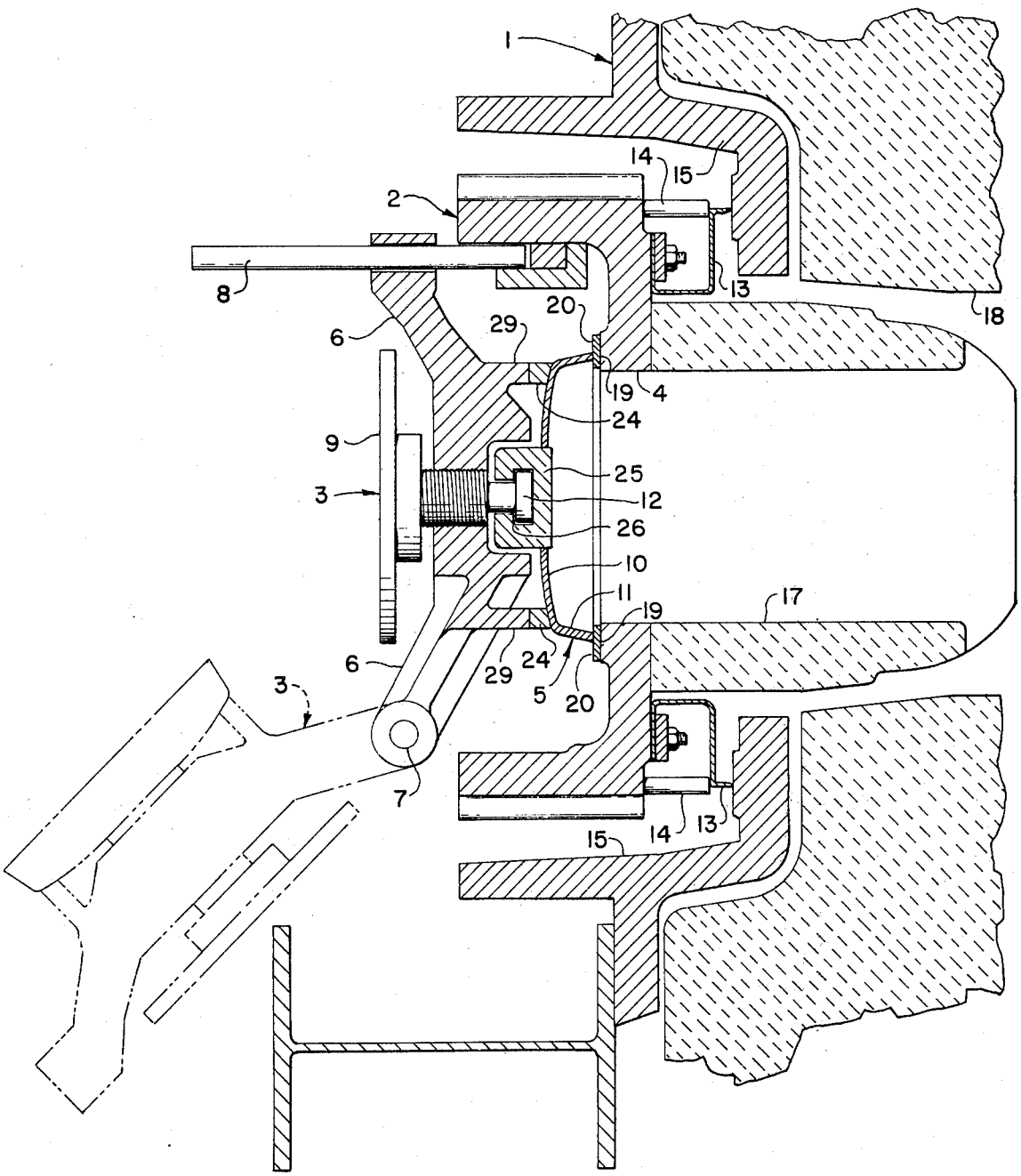
FIG. 1 is a sectional plan view of a conventional coke oven door with a presently preferred embodiment of the leveler door of my invention mounted thereon.

Referring now to the drawings, FIG. 1 shows the leveler door of my invention, generally designated 5, mounted to conventional coke oven door 2. Coke oven door 2 is one of several popular door designs presently used in the industry. Oven door 2 is detachably mounted to coke oven 1, on the pusher side of the oven and sealably egages oven door frame 15 with the knife edge of U-shaped sealing ring 13. Coke oven door 2 has a leveler opening 4 therein and conventional leveler door mounting and latching apparatus, generally designated 3, associated therewith. The conventional leveler door mounting and latching apparatus 3 includes mounting members or strong-back 6 which is pivotally connected by hinge 7 to oven door 2. Strong-back 6 is locked in place during the leveler door closing operation by conventional latching bar 8. A compressive closing force is applied to leveler door 5 by way of hand wheel 9 which turns a conventional threaded lock screw. The lock screw compressively engages the rear of leveler door 5 during the closing operation. The leveler door 5 of my invention is adapted to replace the existing leveler door of conventional coke oven 2 with no modification to the conventional mounting and latching apparatus 3.

Figure 3:
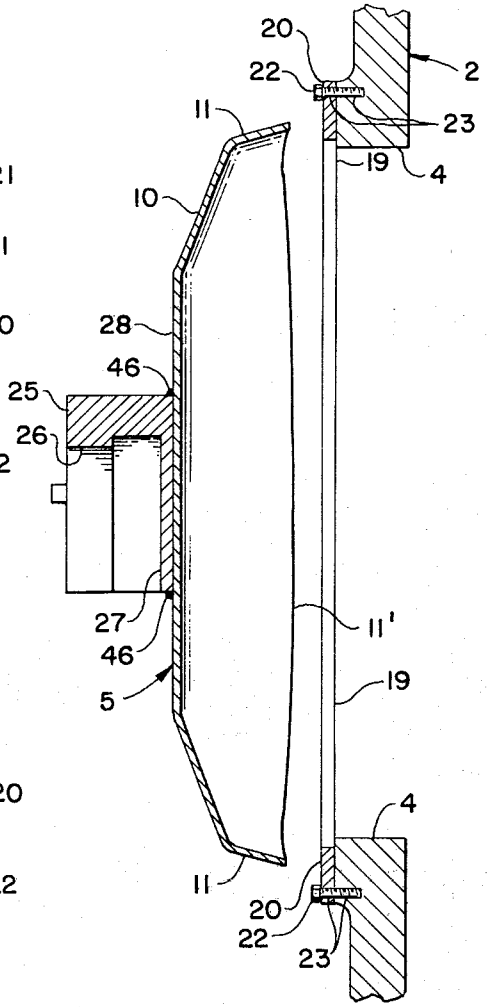
FIG. 3 is a sectional view taken along line III—III of FIG. 2.
Figure 2:
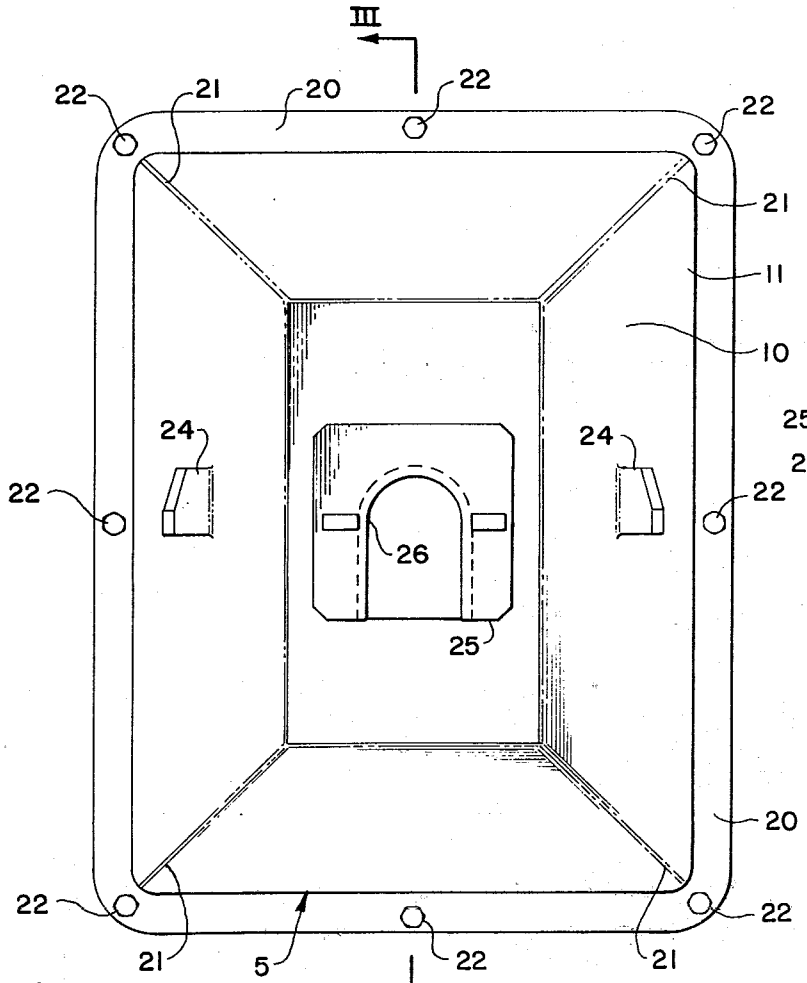
FIG. 2 is a front elevation of one presently preferred embodiment of the leveler door and sealing seat of my invention.

A presently preferred embodiment of my leveler door 5 suitable for use with conventional coke oven door 2 is shown in greater detail in FIGS. 1–3. Leveler door 5 comprises a closure member 10 constructed of a material which possesses spring-like properties at elevated temperatures, preferably stainless steel. The temperature adjacent leveler opening 4 during coking is generally about 900° F; therefore, the material selected for closure member 10 should be capable of retaining its spring-like properties at this temperature. A preferable material for closure member 10 is stainless steel. The particular material selected should, also, have the capability of resisting the corrosive effects of the sulfur bearing gaseous products which are generated during the coking operation. A suitable stainless steel alloy also performs this task well.

Figure 4:
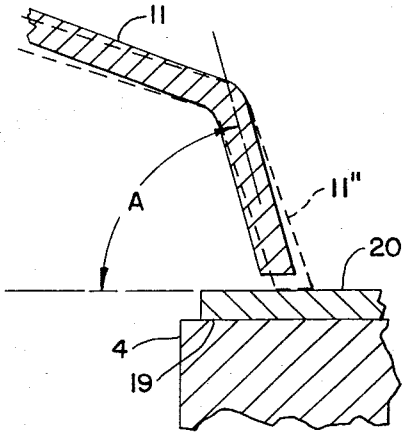
FIG. 4 is a partial sectional view of the sealing edge of the leveler door of my invention.

Closure member 10, is likewise, light gauge, preferably about 3/16 inch in thickness, so as to achieve the desired flexibility. Closure member 10 is generally concave or dish-like in shape having rear portion 28 and terminating in flexible, sealing edge 11 at its outer periphery. The longitudinal, planar axis of the flange or flexible sealing edge 11 is formed at an angle of less than 90° relative to the plane of leveler opening 4. As seen in FIG. 4, the angular relationship between sealing edge 11 and the plane of leveler opening 4 is designated as angle A. Angle A is less than 90° and preferably about 75°, which permits flexible sealing edge 11 to flex outwardly during closing while sealably engaging the sealing area adjacent leveler opening 4. I have found that flexible sealing edge 11 slidably engages the sealing area adjacent leveler opening 4, moving outwardly approximately 1/32 inch during closing. Such movement causes the removal of tarry deposits from the sealing area and thus yields a much improved seal.

Closure member 10 may be formed in one piece as by pressing the desired concave shape from a single sheet of material. Closure member 10 may also be fabricated from several pieces of stainless steel and joined by welding. I have found, however, that the pressed construction yields a more flexible closure, it being noted that the welded seams of the fabricated structure tend to increase the rigidity of the closure member 10 due to the increased thickness of the weld joints. The pressed construction is, likewise, more capable of distorting or flexing under compression closing forces on its common centerlines to assure a metal to metal contact around the seat periphery of the leveler opening.

Leveler door 5 of FIGS. 2–3 may be easily adapted to fit the conventional mounting and latching apparatus 3 of coke oven door 2 of FIG. 1 by the addition of mounting bracket 25 and leveling pads 24. Mounting bracket 25 may be constructed of ductile cast iron and is generally rectangular in shape having a U-shaped channel 26 formed therein. Channel 26 is adapted to be mounted on mounting member 12 of latching apparatus 3 in the same manner as the conventional leveler door is presently mounted on oven door 2. Mounting bracket 25 is secured to the rear portion 28 of closure member 10, preferably by welding. Mounting bracket 25 has a flat, bearing surface 27 on the floor of the U-shaped channel 26 which is adapted to engage the driving end of the conventional lock screw during the closing operation. Leveling pads 24 are positioned on opposite sides of bracket 25 and extend outwardly from rear portion 28 of closure member 10. Pads 24 are adapted to engage seating lugs 29 of strong-back 6 in order to prevent rotative movement of closure member 10 when the lock screw is rotated during closing.

Leveler door 5 is mounted to conventional mounting and latching apparatus 3 and is pivoted into closing position around leveler opening 4 as shown in FIG. 1. Rotative movement of the hand wheel 9 causes the driving end of the lock screw to compressively engage bearing surface 27 of mounting bracket 25. This compressive force is transmitted by bracket 25 to the rear portion 28 of closure member 10, whereby, rear portion 28 flexes toward the leveler opening 4 causing sealing edge 11 to concurrently flex outwardly from the leveler opening 4 while compressively maintaining the sealing edge in sealing engagement with coke oven door 2 in the area adjacent leveler opening 4.

Figure 5:
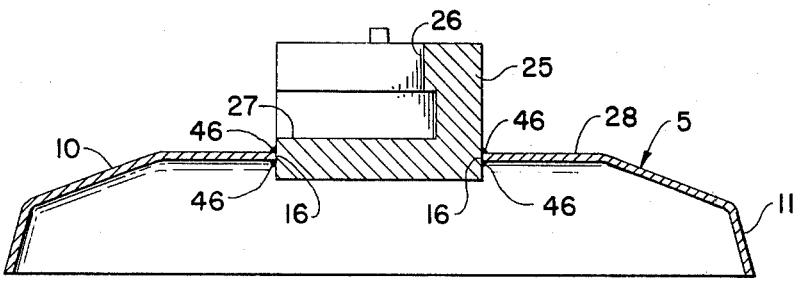
FIG. 5 is a sectional view similar to FIG. 3.

Mounting bracket 25 may be attached to the surface of rear portion 28 by weld bead 46 as shown in FIG. 3. Bracket 25 may also be secured in the manner depicted in FIG. 5, wherein the rear portion 28 of closure member 10 has a rectangular cut-out 16 formed therethrough to receive the lower section of bracket 25. Bracket 25 is then welded in place by weld beads 46 on both sides of rear portion 28. The embodiment of FIG. 5 yields an improved construction since the weld beads 46 on both sides of rear portion 28 distribute the compressive closing forces more evenly to closure member 10.

Referring now to FIG. 3, sealing edge 11 may be modified slightly to yield increased flexibility. In most conventional coke oven doors, leveler opening 4 is rectangular in shape. Leveler door 5 would, likewise, be rectangular in shape for those applications. Portions of sealing edge 11' intermediate the corners 21 of said rectangular shape are formed to extend outwardly a greater distance than corner portions 21. In this manner, intermediate edge portions 11' contact the sealing area adjacent leveler opening 4 prior to the time that corner portions 21 strike the sealing area. Hence, during the closing operation, intermediate edge portions 11' flex outwardly a greater extent than would be the case if sealing edge 11 is formed in a flat plane. It can, therefore, be appreciated that the greater flexibility provided by intermediate sealing edge 11' yields an improved seal between leveler doors 5 and leveler opening 4.

I have also found it preferable to include a sealing seat 20 around the area adjacent leveler opening 4. Sealing seat 20 is, likewise, constructed of a heat resistant and corrosion resistant material such as stainless steel. Sealing seat 20 is provided with a plurality of bolt holes around its periphery and is adapted to be detachably mounted to seating surface 19 of coke oven door 2. Threaded bolt holes 23 are formed in sealing surface 19 of coke oven door 2 to receive bolts 22 therein. Sealing seat 20 thus provides a very low maintenance and long life seal since it is not affected by the corrosive gases generated during the coking operation and is, therefore, not susceptible to the pitting usually found in conventional cast iron sealing seat 19.

Not only does the thin wall construction of closure member 10 yield an improved seal around leveler opening 4, it also provides a cooler door during operation. The thin wall construction of closure member 10 conducts a heat more rapidly than the conventional heavy, cast iron leveler doors presently used. I have found that in normal operation the temperature is approximately 450°–500° F on the outer surface of my leveler door which necessarily eliminates the need for heat shields which sometimes are employed on the leveler doors of the prior art.

Figure 6:
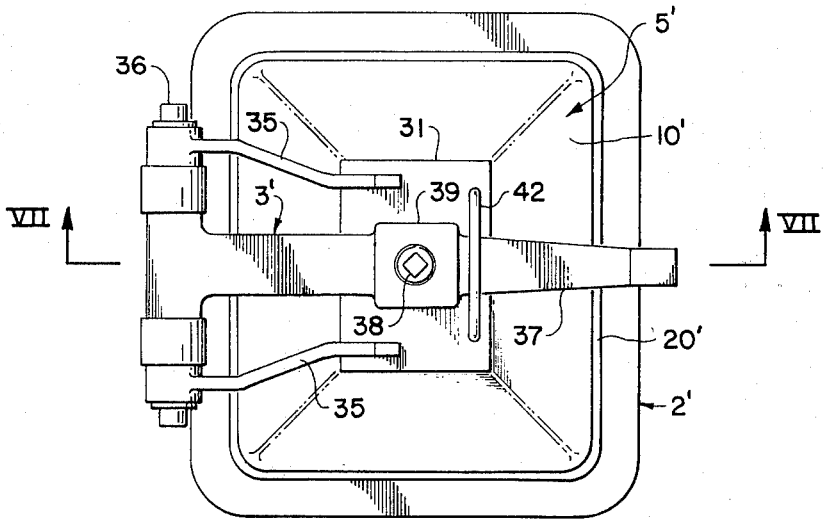
FIG. 6 is a front elevation showing another presently preferred embodiment of the leveler door of my invention mounted on a coke oven door.
Figure 7:
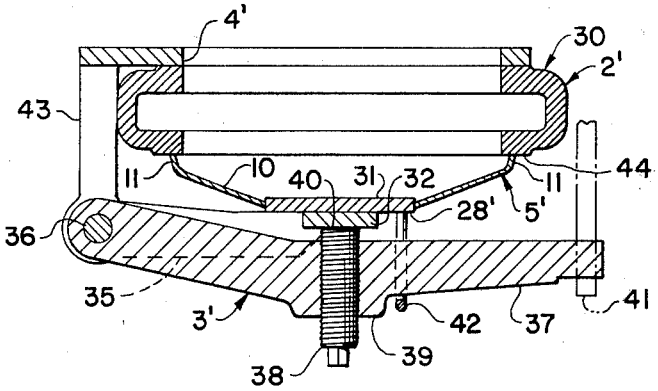
FIG. 7 is a partial sectional plan view taken along line VII—VII of FIG. 6.

Various securement means may be employed to adapt my leveler door for use on coke oven doors of various constructions. Referring now to FIGS. 6 and 7, the leveler door 5' is shown as it would appear mounted on the mounting and latching apparatus 3' of another conventional coke oven door 2' presently used in the industry. Coke over door 2' is characterized by conventional leveler door frame 30, detachably mounted to coke oven door 2', surrounding the leveler opening 4'. A conventional mounting frame 43 is attached to coke oven door 2' and extends outwardly therefrom adjacent leveler opening 4'. Leveler door mounting and latching apparatus 3' is, likewise, provided comprising conventional lever arm 37 which is pivotally attached by pivot hinge 36 to mounting frame 43. In the embodiment of FIGS. 6 and 7, leveler doors 5' comprises a flexible, closure member 10 having terminal sealing edge 11 at its outer periphery. Leveler door 5' is constructed much in the same manner as the embodiments of FIGS. 1–5.

However, in this embodiment, mounting bracket 25 is not employed since the mounting and latching apparatus 3' of coke oven door 2' differs from that of previously described coke oven door 2. A pair of mounting hinges 35 are weldably secured to rear portion 28 of leveler door 5' on either side of conventional lever arm 37. Mounting hinges 35 are pivotally connected by pivot hinge 36 to mounting frame 43 of oven door 2'. A generally U-shaped member 42 is secured to rear portion 28 of closure member 10 and is adapted to act as a stop or retainer when leveler door 5' is to be opened. Lever arm 37 is pivoted at pivot pin 36 independently of mounting hinges 35. Therefore, during the opening operation, lever arm 37 engages U-shaped member 42 thus permitting a door to be pulled open by further movement of lever arm 37. Lever arm 37 also includes a threaded locking screw 38, which is conventional in oven doors of this type. Oven door 2' also includes conventional latching bar 41 which lockably secures lever arm 37 in place during the closing operation. In order to accommodate the mounting and latching apparatus 3' of oven door 2', closure member 10 preferably includes reinforcement means at its rear portion 28. This is preferred since the compressive closing force generated by the mounting and latching apparatus 3' acts directly on rear portion 28 of closure member 10.

Figure 8:
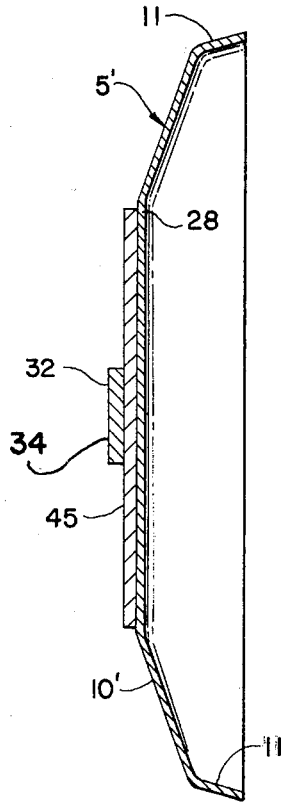
FIG. 8 is a side sectional view of another presently preferred embodiment of the leveler door of my invention.

Closure member 10' may be pressed from one piece of thin gauge metal and then a section of rear portion 28 is removed in a piercing operation. In place of the removed section, a heavier gauge plate 31 may be inserted therein and welded to rear portion 28, FIGS. 6 and 7. Reinforcement may also be accomplished by the embodiment of FIG. 8 wherein closure member 10' is pressed from one piece of thin gauge material and a heavier gauge reinforcement plate 45 is welded to rear portion 28. In this manner, the compressive force generated by closing screw 38 will bear upon reinforcement plate 45 or plate 31 and evenly spread the compressive force over rear portion 28 without causing buckling or denting of the rear portion 28.

Figure 9:
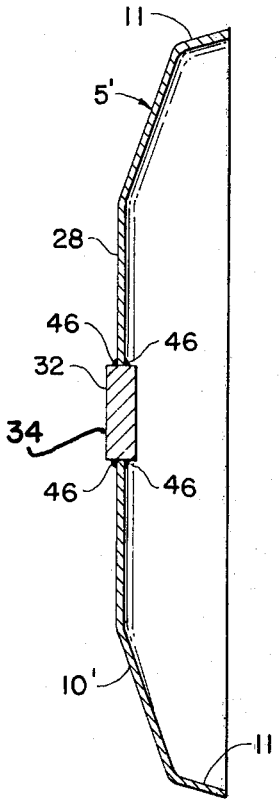
FIG. 9 is a side sectional view of another presently preferred embodiment of the leveler door of my invention.

A bearing plate 32 may also be secured to rear portion 28 of closure member 10', if desired. Bearing plate 32 has a flat surface 34 of a diameter suitable to accept driving end 40 of locking screw 38. Bearing plate 32 may be weldably secured to plate 31 as in FIG. 7, or to reinforcing plate 45 in the manner shown in FIG. 8. Bearing plate 32 may also be used as the sole means of reinforcing rear portion 28 as shown in FIG. 9. In this embodiment, a cut-out portion is formed through rear portion 28 of closure 10 to receive bearing plate 32 therein. Weld beads 46 are applied on both sides of rear portion 28 to secure bearing plate 32 in place.

Figure 10:
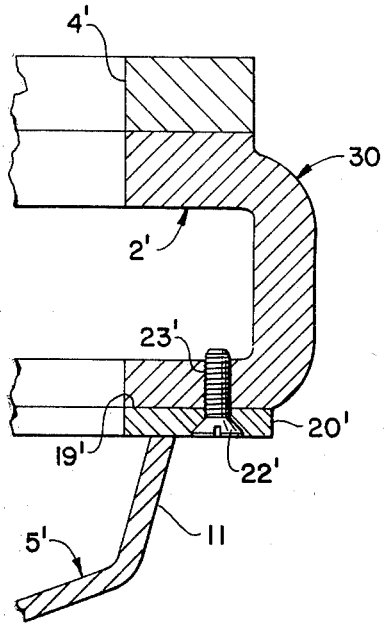
FIG. 10 is a partial sectional view of the sealing edge and sealing seat of my invention.

Leveler door 5' is adapted to seal leveler opening 4' adjacent conventional leveler door frame 30 of oven door 2'. However, conventional leveler door frame 30, as shown in FIG. 7, may be modified to accept the removable sealing seat 20' shown in FIG. 10. Sealing seat 20' is also preferably constructed of a stainless steel alloy having heat and corrosion resistant properties and is preferably about 3/8 inch in thickness. If sealing seat 20' is to be installed on conventional leveler door frame 30, the outwardly extending sealing surface 44 of FIG. 7 is removed by machining. The removable sealing seat 20' is then attached to conventional leveler door frame 30 by way of bolts 22' which are threadably secured within threaded bolt holes 23' formed along the machined surface 19 of leveler door frame 30. Sealing seat 20' may also be attached by way of conventional studs and nuts (not shown). Due to the relatively thin wall construction of conventional door frame 30, the bolt holes 23 may extend completely through the side walls of frame 30 and, therefore, a high temperature sealant is preferably applied to bolts 22' in order to prevent leakage of gases from the oven through both holes 23'.

While leveler door 5 has been previously described as being generally rectangular in shape, it can be appreciated that it may be modified to fit leveler door openings of any shape. For example, closure member 10 may be formed to be circular or oval in order to sealably contact either circular or oval leveler door openings. In such modified structures, leveler door 5 would still be flexible and would retain its concave or dish-like shape with the same flexible sealing edge as previously described. Leveler door 5 could also be further modified within the spirit of my invention to include a closure member which has a relatively rigid rear portion terminating in a flexible sealing edge at its outer periphery. The sealing edge would be formed at an angle of less than 90° relative to the plane of the leveler opening as previously described. In such a modified structure, the rear portion of the closure could be a heavier gauge plate with the thinner gauge sealing edge attached thereto by welding or by bolts or the like.

While several presently preferred embodiments of my invention have been described herein, it is understood that certain modifications can be made without departing from the scope of the appended claims.

I claim:

1. A leveler door for sealing the leveler opening in a coke oven door of the type having leveler door mounting and latching apparatus associated therewith, said leveler door comprising:

a flexible closure member constructed of a sheet metal material possessing resilient spring properties at elevated temperatures, said member having a generally concave shape including a rear portion for transmitting compressive closing forces from the leveler door mounting and latching apparatus and terminating in a peripheral sealing edge lying in a plane planes forming an angle of less than 90° relative to the plane of the leveler opening, said sealing edge radially slidable engaging, scraping and compressively sealing the area around the leveler opening when subjected to said compressive closing force.

2. A door construction adapted to seal an opening in a coke oven or the like, said coke oven having door mounting and latching apparatus adjacent the opening to be sealed, said door construction comprising:

A. a closure member constructed of a sheet metal material possessing resilient spring properties at elevated temperatures, said closure members having a generally concave shape including a rear portion and terminating in a sealing edge at its outer periphery, said sealing edge lying in planes forming an inclined angle of less than 90° relative to the plane of the opening to be sealed, said sealing edge adapted to radially slidably engage and scrape the area around the opening when a compressive closing force is applied to the rear of the closure member; and B. means associated with the rear portion of the closure member for securing said closure member to the door mounting and latching apparatus to permit the application of a compressive closing force to the rear of the flexible closure member, whereby, said rear portion moves toward the opening being sealed, transmitting the compressive closing force to the sealing edge to springably maintain said sealing edge in compressive engagement with the area around said opening when the door is in the closed and latched position.

3. A door construction adapted to seal an opening in a coke oven, said coke oven having door mounting and latching apparatus adjacent the opening to be sealed, said door construction comprising:

a flexible closure member having a generally concave shape including a rear portion for transmitting compressive closing forces from the door mounting and latching apparatus and terminating in a sealing edge at its outer periphery, said closure member constructed of stainless steel having a thickness of about 3/16 inch and possessing resilient, spring properties at elevated temperatures, said sealing edge lying in planes forming an inclined angle at about 75° relative to the plane of the opening to be sealed and adapted to radially slidably engage and scrape the area around said opening when the compressive closing force is applied to rear of the flexible closure member, and adapted to springably maintain a compressive seal around said opening when the door is in a fully closed and latched position.

4. A leveler door construction adapted to seal an opening in a coke oven comprising:

A. a closure member having a generally concave shape including a rear portion and terminating in a flexible sealing edge at its outer periphery, said sealing edge constructed of stainless steel having a thickness of about 3/16 inch, said sealing edge possessing resilient, spring properties at elevated temperatures and lying in planes forming an inclined angle of about 75° relative to the plane of the opening to be sealed and sloping outwardly from said opening, said sealing edge adapted to radially slidably engage and scrape the area around said opening, flexing outwardly therefrom when a compressive closing force is applied to the closure member, and adapted to compressively engage the area around said opening when the door is in a fully closed position; and B. door mounting and latching means operably positioned adjacent the opening to be sealed, and means associated with said closure member for securing the closure member to the door mounting and latching means to permit the application of a compressive closing force to the closure member.

5. A leveler door for sealing the leveler opening in a coke oven door, said coke oven door of the type having leveler door mounting and latchng apparatus associated therewith, said leveler door comprising:

A. a closure member constructed of sheet stainless steel possessing resilient spring properties at elevated temperatures, said closure member having a generally concave shape including a rear portion and terminating in a sealing edge at its outer periphery, said sealing edge lying in planes forming an inclined angle of less than 90° relative to the plane of the leveler opening, said sealing edge adapted to radially slidably engage, scrape and compressively seal the area around the leveler opening, when a compressive closing force is applied to the rear of the closure member; and B. means associated with the rear portion of the closure member for securing said closure member to the leveler door mounting and latching apparatus of the coke oven door to permit the application of a compressive closing force to the rear of the closure member, whereby the rear of said closure member flexes toward the leveler opening transmitting the compressive closing force to the sealing edge to springably maintain the sealing edge in compressive engagement with the area around the leveler opening when said leveler door is in a fully closed and latched position.

6. A leveler door for sealing the leveler opening in a coke oven door, said coke oven door of the type having leveler door mounting and latching apparatus associated therewith, said leveler door comprising:

A. a closure member constructed of a sheet metal material possessing resilient spring properties at elevated temperatures, said closure members having a generally concave shape including a rear portion and terminating in a sealing edge at its outer periphery, said sealing edge lying in planes forming an inclined angle of less than 90° relative to the plane of the leveler opening, said sealing edge adapted to radially slidably engage, scrape and compressively seal the sealing seat around the leveler opening, when a compressive closing force is applied to the rear of the closure member; and B. means associated with the rear portion of the closure member for securing said closure member to the leveler door mounting and latching apparatus of the coke oven door to permit the application of a compressive closing force to the rear of the closure member, whereby, the rear of said closure member flexes toward the leveler opening transmitting the compressive closing force to the sealing edge to springably maintain the sealing edge in compressive engagement with the area around the leveler opening when said leveler door is in a fully closed and latched position.

7. The leveler door of claim 6 wherein said securement means comprises a rectangularly shaped mounting bracket fixedly attached to the rear of the closure member, said mounting bracket having a U-shaped channel formed therein adapted for attachment to the leveler door mounting and latching apparatus of the coke oven door, said securement means also including a pair of leveling pads mounted on the rear of the closure member and outwardly extending therefrom, said pads positioned on opposite sides of said mounting bracket in spaced apart relationship therefrom, whereby, the compressive, closing force generated by the leveler door mounting and latching apparatus of the oven door are directed to said mounting bracket and transmitted by said bracket to the flexible closure member and said leveling pads adapted to engage the mounting and latching apparatus to prevent rotative movement of the closure member relative to said mounting and latching apparatus during the closing operation.

8. The leveler door of claim 6 wherein the periphery of the sealing edge of the closure member is generally rectangular in plan view, portions of the sealing edge intermediate the corners of said rectangular shape extending toward the sealing seat a greater distance than said corners, whereby, during the closing operation, said intermediate edge portions contact the sealing area adjacent the leveler opening prior to the corner portions.

9. The leveler door of claim 6 wherein said securement means includes reinforcing means secured to the rear portion of said flexible closure member, a pair of mounting hinges outwardly extending from the rear portion of said closure member and fixedly attached thereto, said pair of mounting hinges adapted to be pivotally attached to the mounting and latching apparatus of the coke oven door positioned on either side of the lever arm thereof, whereby the compressive closing forces generated by the lever arm of the coke oven door mounting and latching apparatus are directed to said reinforcing means and transmitted by said reinforcing means to the flexible closure member, said securement means also including a U-shaped retainer member, fixedly attached to and outwardly extending from the rear of the closure member, said U-shaped member adapted to cooperate with the lever arm of the coke oven door, whereby during the opening operation, said U-shaped member engagably contacts the lever arm to pivotally move said leveler door with said mounting hinges to an open position.

10. The leveler door of claim 9 wherein the reinforcing means comprises a bearing plate weldably secured to the rear of the closure member, said bearing plate having a flat surface thereon adapted to receive the compressive closing force generated by the lever arm of the coke oven door mounting and latching apparatus.

11. The leveler door of claim 9 wherein the reinforcing means comprises a reinforcing plate weldably secured to the rear portion of the closure member and a bearing plate weldably secured to the reinforcing plate having a flat surface thereon adapted to receive the compressive closing force generated by the lever arm of the coke oven door mounting and latching apparatus.

12. A leveler door sealing construction for use on a leveler opening in a coke oven door, said coke oven door of the type having leveler door mounting and latching apparatus associated therewith, said leveler door sealing construction comprising:

A. a sealing seat constructed of a heat resistant and corrosion resistant material, said sealing seat adapted to be detachably secured to the coke oven door around the leveler opening therein;

B. a closure member constructed of a sheet metal material possessing resilient spring properties at elevated temperatures, said closure member having a generally concave shape including a rear portion and terminating in a peripheral sealing edge at its outer periphery, said sealing edge lying in planes forming an inclined angle of less than 90° relative to the plane of the leveler opening, said sealing edge adapted to radially slidably engage and scrape the sealing seat when a compressive closing force is applied to the rear of the closure member; and C. means associated with the rear portion of the closure member for securing said closure member to the leveler door mounting and latching apparatus of the coke oven door to permit the application of a compressive closing force to the rear of the closure member, whereby, during closing, the rear of said closure member flexes toward the leveler opening transmitting the compressive closing force to the sealing edge to springably maintain the sealing edge in compressive engagement with said sealing seat when said leveler door is in a fully closed and latched position.

13. The leveler door sealing construction of claim 12 wherein the closure member and the sealing seat are constructed of stainless steel.

14. The leveler door sealing construction of claim 13 wherein the stainless steel of the closure member is about 3/16 inch in thickness and the stainless steel of the sealing seat is about ⅜ inch in thickness.

15. A leveler door for sealing the leveler opening in a coke oven door of the type having leveler door mounting and latching apparatus associated therewith, said leveler door comprising:

a flexible closure member constructed of a sheet stainless steel possessing resilient spring properties at elevated temperatures, said member having a generally concave shape including a rear portion for transmitting compressive closing forces from the leveler door mounting and latching apparatus and terminating in a peripheral sealing edge lying in planes forming an angle of less than 90° relative to the plane of the leveler opening, said sealing edge radially slidably engaging, scraping and compressively sealing the area around the leveler opening when subjected to said compressive closing force.

16. The leveler door of claim 15 wherein the stainless steel has a thickness of about 3/16 inch.

17. The leveler door of claim 16 wherein the planar angle of the sealing edge is formed at an angle of about 75° relative to the plane of the leveler opening.

18. A door construction adapted to seal an opening in a coke oven or the like, said coke oven having door mounting and latching apparatus adjacent the opening to be sealed, said door construction comprising:

A. a closure member constructed of sheet stainless steel possessing resilient spring properties at elevated temperatures, said closure member having a generally concave shape including a rear portion and terminating in a sealing edge at its outer periphery, said sealing edge lying in planes forming at an inclined angle of less than 90° relative to the plane of the opening to be sealed, said sealing edge adapted to radially slidably engage and scrape the area around the opening when a compressive closing force is applied to the rear of the closure member; and B. means associated with the rear portion of the closure member for securing said closure member to the door mounting and latching apparatus to permit the application of a compressive closing force to the rear of the flexible closure member, whereby said rear portion moves toward the opening being sealed, transmitting the compressive closing force to the sealing edge to springably maintain said sealing edge in compressive engagement with the area around said opening when the door is in the closed and latched position.

19. The door of claim 18 wherein the stainless steel is of a thickness of about 3/16 inch.

20. The door of claim 18 wherein the planes of the sealing edge are formed at an angle of about 75° relative to the plane of the opening to be sealed.

* * * * *

UNITED STATES PATENT OFFICE

CERTIFICATE OF CORRECTION

PATENT NO. : 3,990,950

DATED : November 9, 1976

INVENTOR(S) : Hugh B. Carr

It is certified that error appears in the above-identified patent and that said Letters Patent are hereby corrected as shown below:

Column 1 Line 33 "over" should read --oven--.
Column 1 Line 34 "case" should read --cast--.
Column 1 Line 42 "operation." should read --operations.--.
Column 2 Line 61 "egages" should read --engages--.
Column 2 Line 67 "members" should read --member--.
Column 3 Line 13 "FIGS. 1-3." should read --FIGS. 2-3.--.
Column 3 Line 56 "compression" should read --compressive--.
Column 5 Line 5 Delete "a".
Column 5 Line 27 "doors" should read --door--.

Claim 1 - Column 7 Line 8 Delete "a plane".
Claim 1 - Column 7 Line 10 "slidable" should read --slidably--.

Signed and Sealed this

Eighth Day of February 1977

[SEAL]

*Attest:*

RUTH C. MASON
*Attesting Officer*

C. MARSHALL DANN
*Commissioner of Patents and Trademarks*